US011596564B2

(12) United States Patent
Smith

(10) Patent No.: US 11,596,564 B2
(45) Date of Patent: Mar. 7, 2023

(54) ROTATING BATH LIFT

(71) Applicant: Platinum Health, LLC, Orlando, FL (US)

(72) Inventor: Randall L. Smith, Orlando, FL (US)

(73) Assignee: Platinum Health, LLC, Orlando, FL (US)

( * ) Notice: Subject to any disclaimer, the term of this patent is extended or adjusted under 35 U.S.C. 154(b) by 266 days.

(21) Appl. No.: 17/119,494

(22) Filed: Dec. 11, 2020

(65) Prior Publication Data

US 2021/0186785 A1 Jun. 24, 2021

Related U.S. Application Data

(60) Provisional application No. 62/949,792, filed on Dec. 18, 2019.

(51) Int. Cl.
*A61G 7/10* (2006.01)
*A47K 3/12* (2006.01)

(52) U.S. Cl.
CPC ..... *A61G 7/1003* (2013.01); *A47K 3/122* (2013.01); *A61G 7/1013* (2013.01); *A61G 7/1074* (2013.01); *A61G 7/1088* (2013.01); *A61G 2203/10* (2013.01)

(58) Field of Classification Search
CPC .. A61G 7/1003; A61G 7/1013; A61G 7/1019; A47K 3/122
See application file for complete search history.

(56) References Cited

U.S. PATENT DOCUMENTS 5,708,992 A * 1/1998 Gobbers ..... A61G 7/1088 4/578.1
5,822,809 A * 10/1998 Gallo ..... A47K 3/122 4/578.1
2004/0098801 A1* 5/2004 Sherlock ..... A61G 7/1003 4/579
2017/0367540 A1* 12/2017 Chang ..... A47K 3/122
2020/0390626 A1* 12/2020 Kempter ..... A61G 7/1088
2021/0378897 A1* 12/2021 Veloz ..... A47K 3/122

FOREIGN PATENT DOCUMENTS

KR 20170088245 * 8/2017 ..... A47C 7/62
WO WO 2008149122 * 12/2008 ..... A61G 7/1003

* cited by examiner

*Primary Examiner* — J C Jacyna
(74) *Attorney, Agent, or Firm* — McHale & Slavin, P.A.

(57) ABSTRACT

Disclosed is a bath lift with a rotating seat assembly to assist an individual with decreased mobility in and out of a bathtub. The rotating seat includes an assembly that can be raised or lowered using a DC powered linear actuator. The linear actuator will also move a backrest from an upright position to a reclined position. A controller includes logic to prevent operation should the batteries have insufficient power to raise the seat assembly. Slip resistant padding is comprised of medical-grade, closed cell, molded polyurethane padding that does not absorb water and reduces the risk of skin tears.

12 Claims, 8 Drawing Sheets

ROTATING BATH LIFT

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/949,792, entitled "ROTATING BATH LIFT", filed Dec. 18, 2019. The contents of the above referenced application are incorporated herein by reference.

FIELD OF THE INVENTION

The present invention relates generally to bath lifts for assisting a disabled individual to get in and out of a bathtub. More specifically, this device is an improved bath lift with a rotating seat assembly.

BACKGROUND OF THE INVENTION

Loss of independence and privacy in the bathroom can be extremely difficult for the disabled and elderly population. A particularly hazardous endeavor in the bathroom is bathing. Bathtubs are likely the most popular fixture for bathing. Modern bathtubs come in a variety of shapes and may be constructed of porcelain, thermoformed acrylic, enameled steel, fiberglass reinforced polyester, or porcelain enameled cast iron. While the bathtub has proven to be one of the best devices for bathing, the materials of construction are often extremely slippery and the bathtub shape typically requires stepping up and over an upper rim of the tub in order to get in. Many people with diminished mobility will resort to holding on to the slippery rim of the tub, or towel bars, shower curtains and other bathroom fixtures. The problem is that the bathtub coating may be slippery as it is designed for easy cleaning, and most bathroom fixtures are not sturdy enough to support the weight of a person, and that assumes that the individual even has the strength and capacity to hold themselves up when grabbing onto one of these fixtures. Slip and falls in the bathtub are major problems for the disabled and elderly population.

Avoidance of a slip and fall resulting in serious injuries is a top priority to protect the disabled and elderly population when bathing. Currently, there are many bath lifts in the marketplace that assist a person in getting in and out of the bathtub. Existing bath lifts consist of a seat that is placed in the tub and can be raised and lowered by the individual in the chair. However, it can be difficult for many disabled and elderly people to initially get into the chair. Rigid chairs can be slippery and can also cause skin tears as a person maneuvers to properly position themselves upon the bath lift seat in the tub.

Accordingly, what is needed to improve safety in the bathtub, for the most vulnerable members of society, is a bath lift with a soft, slip resistant rotating seat.

SUMMARY OF THE INVENTION

The present invention is an improved bath lift having a novel rotating seat assembly to safely assist an individual with diminished mobility in and out of a bathtub. The rotating seat is comprised of a base having a recessed cavity with an insert. The seat is configured to be comfortable, functional and capable of withstanding a wet environment.

Accordingly, it is an objective of the instant invention to have a rotatable seat surface that is waterproof.

It is a further objective of the instant invention to construct the rotatable seat surface to be slip resistant when human skin contacts the surface.

It is yet another objective of the instant invention to incorporate medical grade slip resistant padding that doesn't absorb water.

It is a still further objective of the invention to avoid skin tears of the people using the seat.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
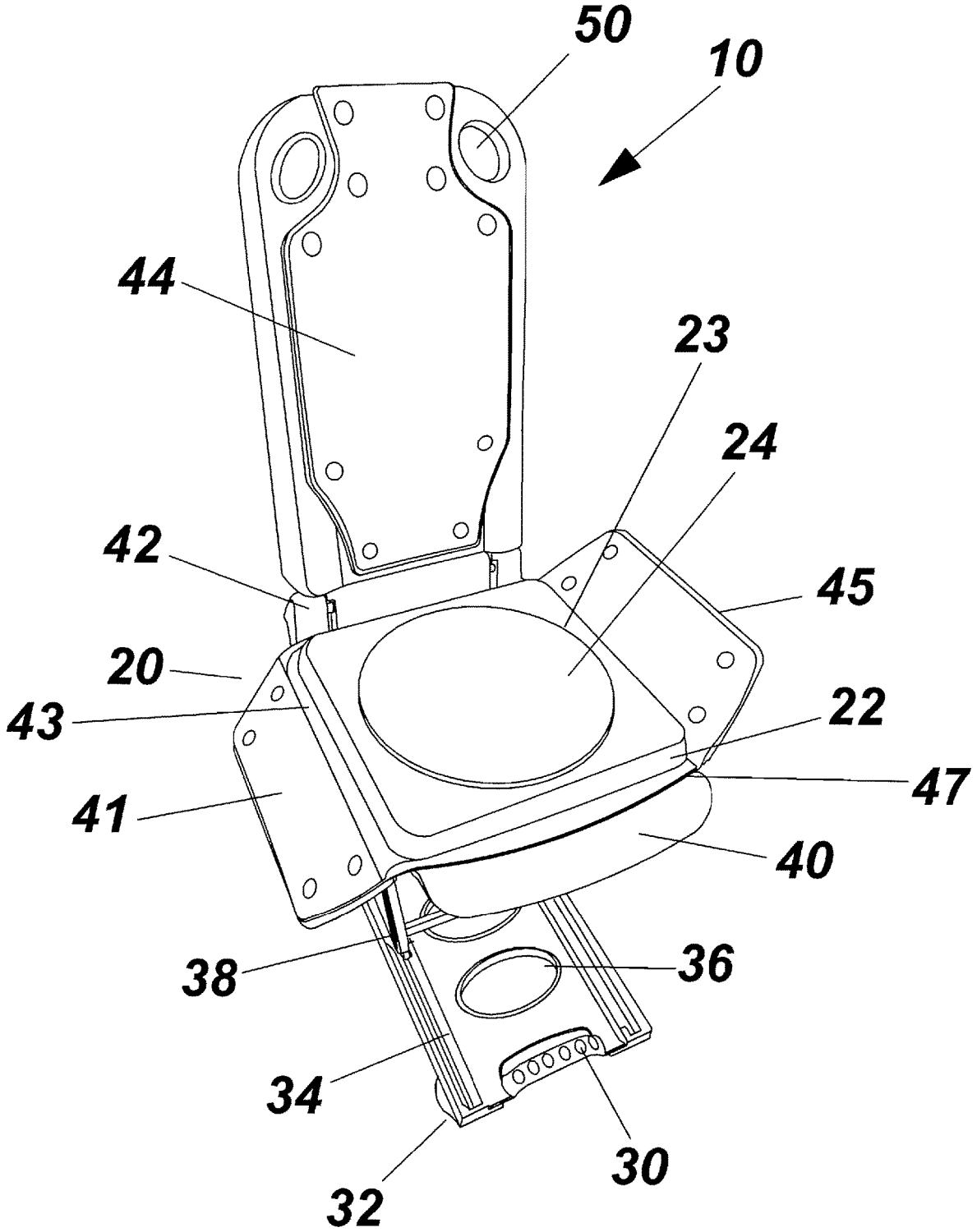
FIG. 1 is a pictorial view of the present invention.
Figure 2:
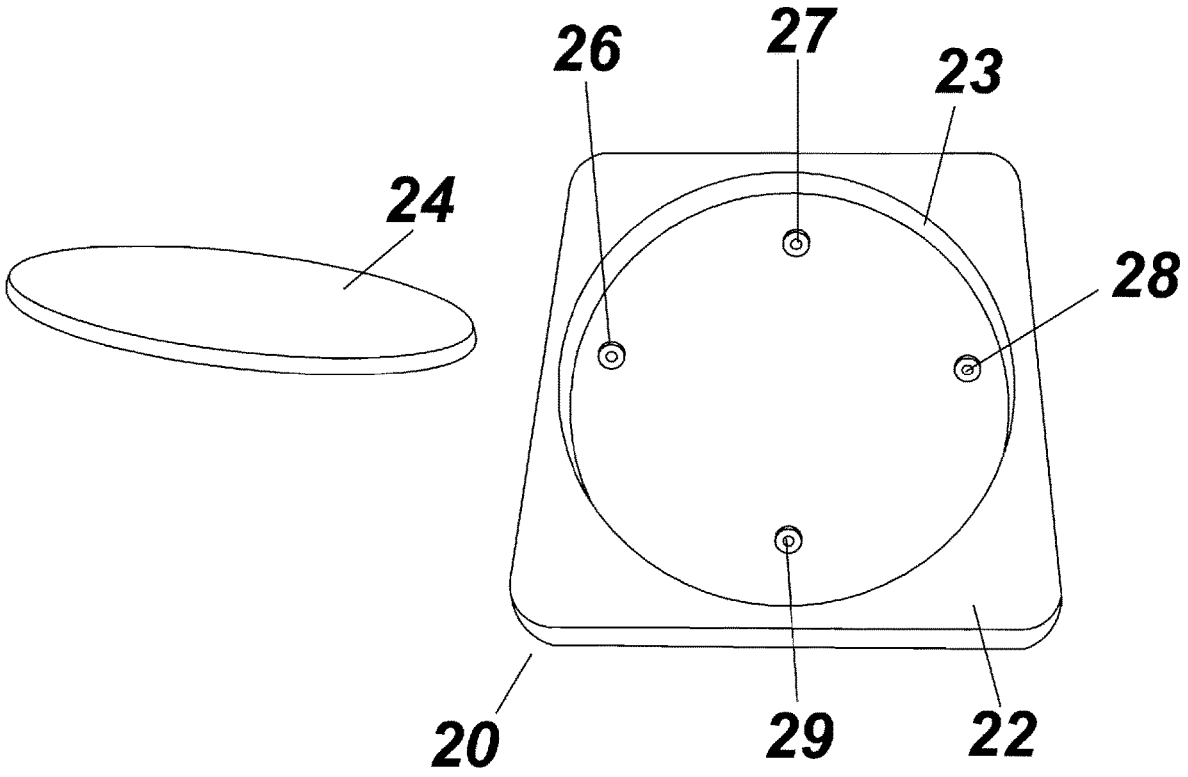
FIG. 2 is an exploded top view of the rotating seat of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

FIG. 1 is a bath lift with an improved rotating seat assembly 20. The bath lift 10 is comprised of a base 30 having a plurality of suction cups 32 fixedly attached to the bottom of the base 30 for securing the bath lift within a bathtub. The base 30 includes at least two parallel channels 34 and 36 constructed and arranged to cooperate with a scissor rod assembly 38 for raising and lowering the seat assembly 20. Fixedly attached to the seat assembly 20 is a hinge assembly 42. A backrest 44 is attached to the seat assembly 20 by a hinge assembly 42. A DC powered linear actuator 50 that has at least two linkages 52 and 54 is attached to a scissor rod assembly by the first linkage 52 and to the backrest 44 by the second linkage 54. The linear actuator 50 is multipurpose, and constructed and arranged for raising and lowering the seat assembly 20. The linear actuator 50 is also constructed and arranged for tilting of the backrest 44 between an upright and reclined position. A controller 60 includes a battery monitor with intelligent logic to prevent lowering the seat assembly 20 if there is not enough power to raise the seat assembly. This prevents an individual lowering the seat assembly 20 into a bathtub and not being able to raise the seat assembly after bathing.

The rotating seat assembly 20 is comprised of a base having a recessed cavity 23 of a predetermined depth. An insert 24 is constructed and arranged to be rotatably positioned within said recessed cavity 23. The base 22 has a plurality of apertures 26, 27, 28 and 29 configured for drainage of water from the recessed cavity area 23. Additionally, the rotating seat assembly 20 is fixedly attached to seat assembly 40 with a plurality of fasteners (not shown).

The rotating seat assembly 20 surfaces are comprised of materials that are waterproof and slip resistant when human skin contacts the surfaces. For further comfort, the rotating seat assembly 20 includes slip resistant padding comprised of medical-grade, closed cell, molded polyurethane padding that will not absorb water. In a preferred embodiment, the materials that comprise the surfaces of the rotating seat assembly 20 have a coefficient with minimal static friction to avoid skin tears.

Figure 3:
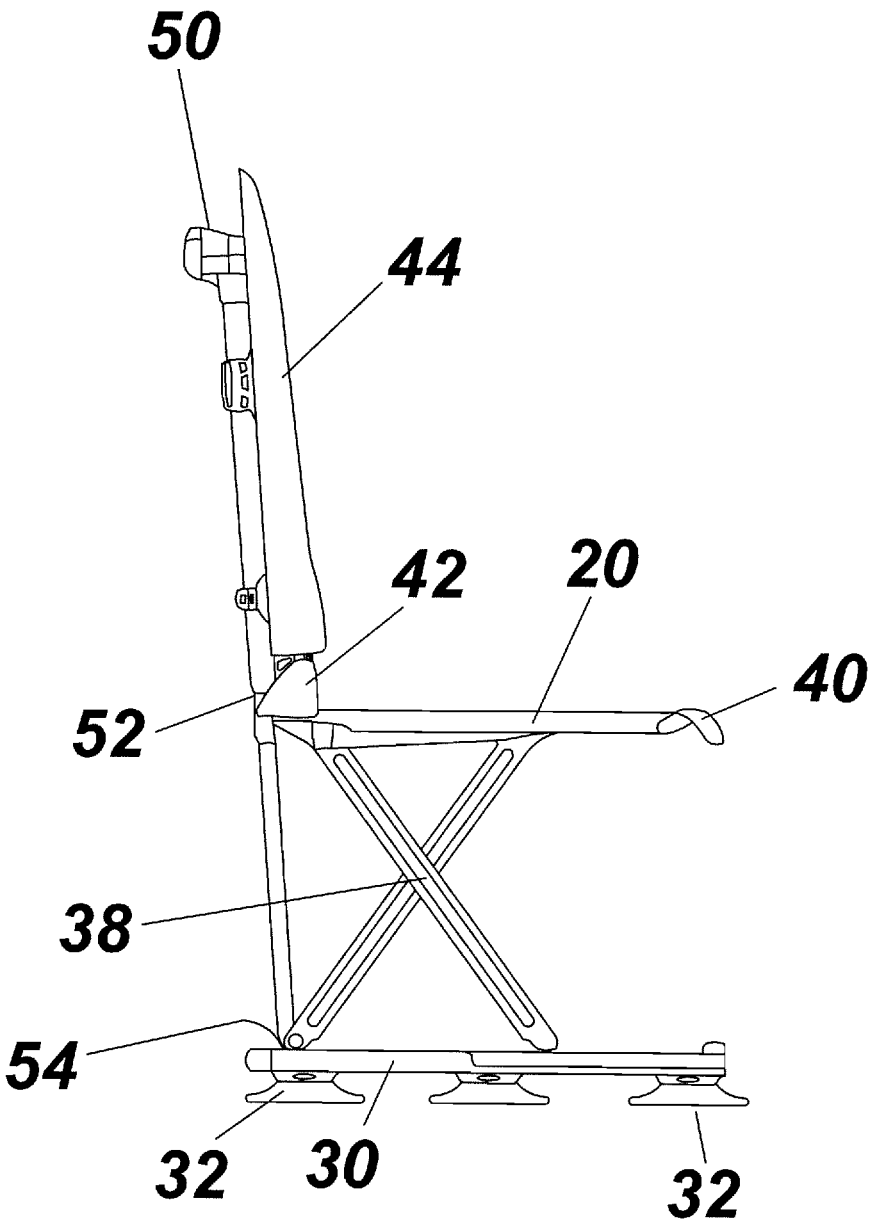
FIG. 3 is a side perspective view of the bath lift in the extended position.
Figure 4:
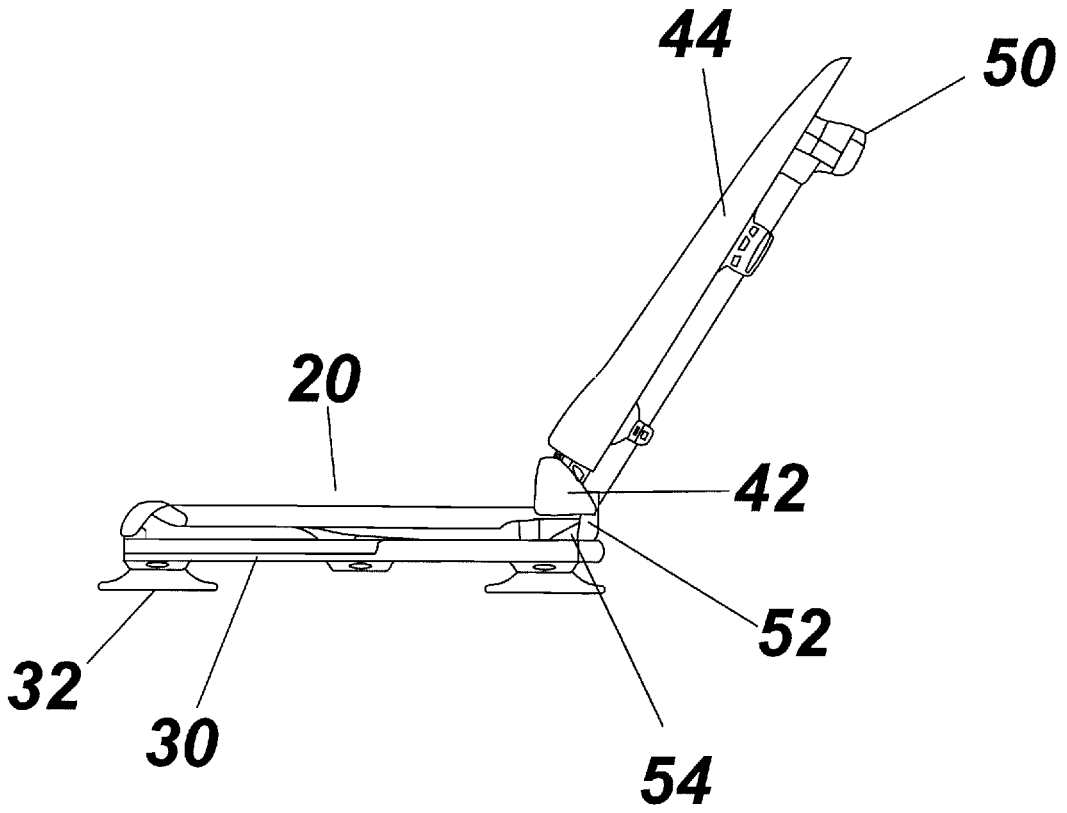
FIG. 4 is a side view of the bath lift in a lowered position with the backrest reclined.

In one embodiment, linkage 52 is constructed and arranged to attach to hinge 42 to rotate the backrest 44 between an upright position depicted in FIG. 3 and a reclined position depicted in FIG. 4. Linkage 54 is attached to the scissor rod assembly 38 and is constructed and arranged to raise the seat assembly 20 as depicted in FIG. 3 wherein the linear actuator is fully deployed, or lower the seat assembly wherein the linear actuator is fully retracted as depicted in FIG. 4. The hinge assembly 42 allows the backrest 44 to remain upright upon near total retraction of the linear actuator or total retraction allows for the backrest 44 to recline. For effective use in the bathtub, the linear actuator assembly 50 has a watertight construction. The linear actuator assembly 50 is operated with the multi-functional controller 60 configured to operate linkage 52 and 54.

Figure 5:
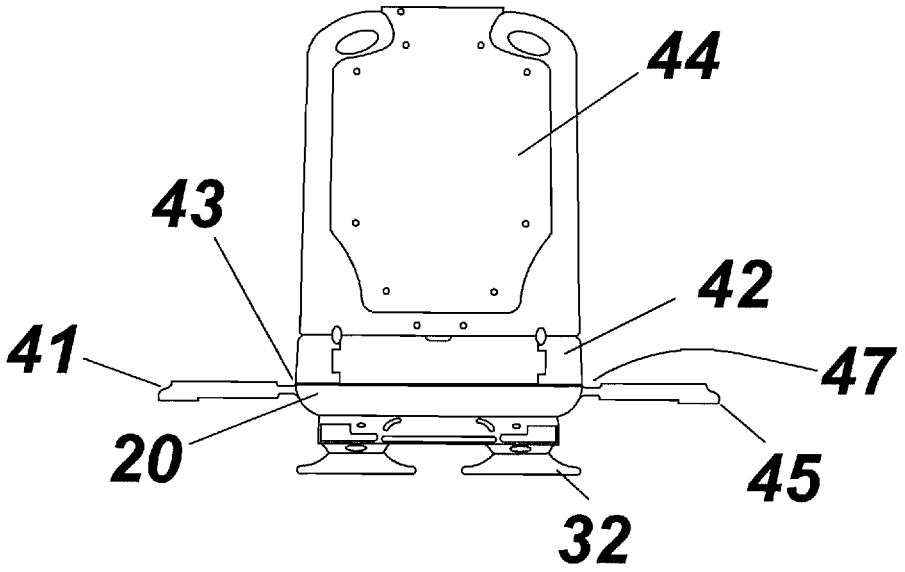
FIG. 5 is a front view of the bath lift in a lowered position with the backrest upright.

FIGS. 3-5 illustrate various operational capabilities of the present invention. In a preferred embodiment, the scissor rod assembly 38 is of a predetermined size and configured to raise the seat assembly 20 to a height that is above the upper rim of a bathtub. Flap 41 is secured to the seat assembly 40 by a living hinge 43 which can be placed over the lip of a bathtub when the seat assembly 40 is placed at the same height as the bathtub lip allow an individual to have support from the bathtub while positioning on the pad 24. Similarly flap 45 is secured to the seat assembly 40 by a living hinge 47 which can be placed over the lip of a bathtub when the seat assembly 40 is placed at the same height as the bathtub lip allow an individual to have support from the bathtub while positioning on the pad 24 should the seat assembly be placed in an opposing direction. The flaps 41, 45 flex using the living hinge allowing the seat assembly 40 to be lowered into the bathtub.

Figure 6:
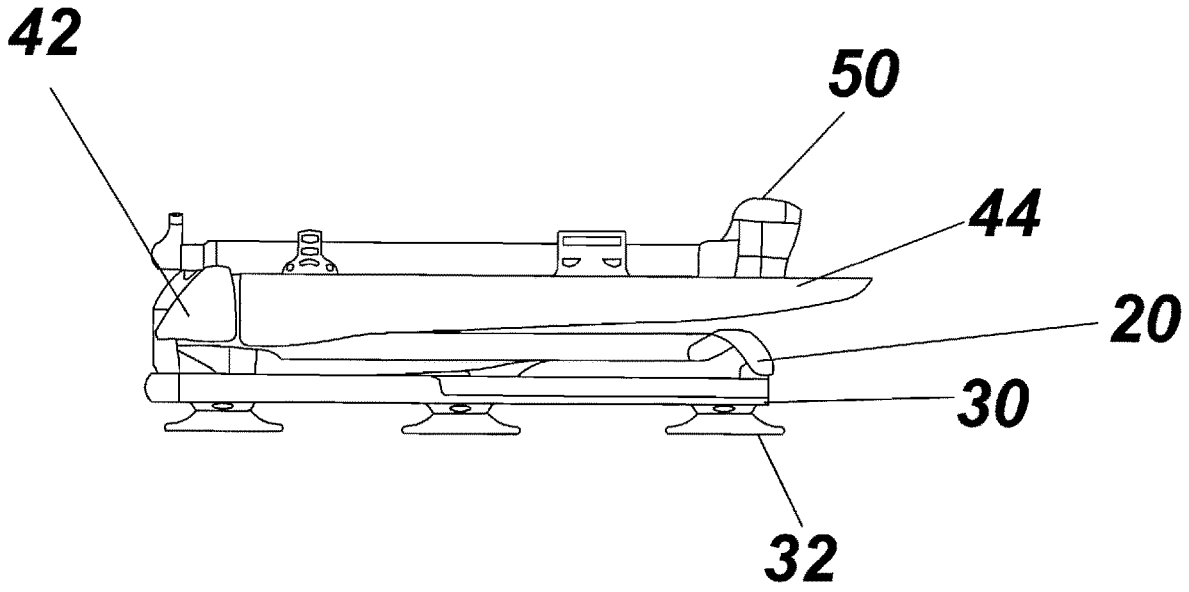
FIG. 6 is a side view of the bath lift in a stowed position.
Figure 7:
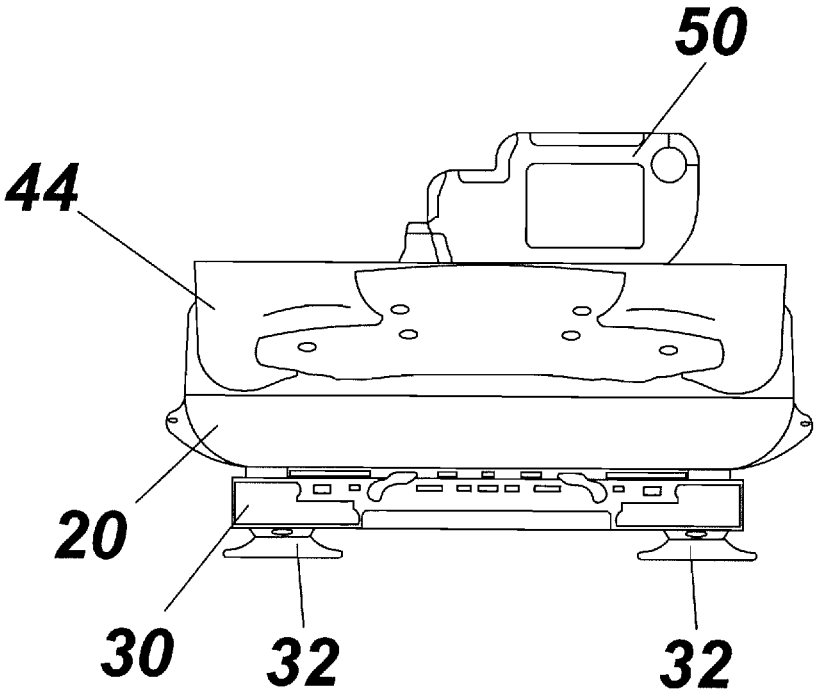
FIG. 7 is a front view of the bath lift in a stowed position.

A individual would sit on the insert 24 and rotate their body into the bathtub when the seat assembly 40 is raised to the height of the bathtub lip. Once seated the scissor rod assembly 38 can be lowered into the bathtub. The backrest 44 can then reclined if so desired or remain in an upright position. The linear actuator 50 can be locked into position while a person is getting in and out of the bath lift. Additionally, the linear actuator 50 is an electro-mechanical system with intelligent logic that prevents lowering the seat assembly if there is not enough power to raise the seat assembly or allow tilting of the backrest if there is not enough power to return the backrest to an upright position. When not in use, as shown in FIGS. 6-7, the bath lift can be stowed in a compact position. The bath lift is operated by a handset controller having raise and lower buttons, and a selector between the backrest and the scissor rod assembly.

Figure 8:
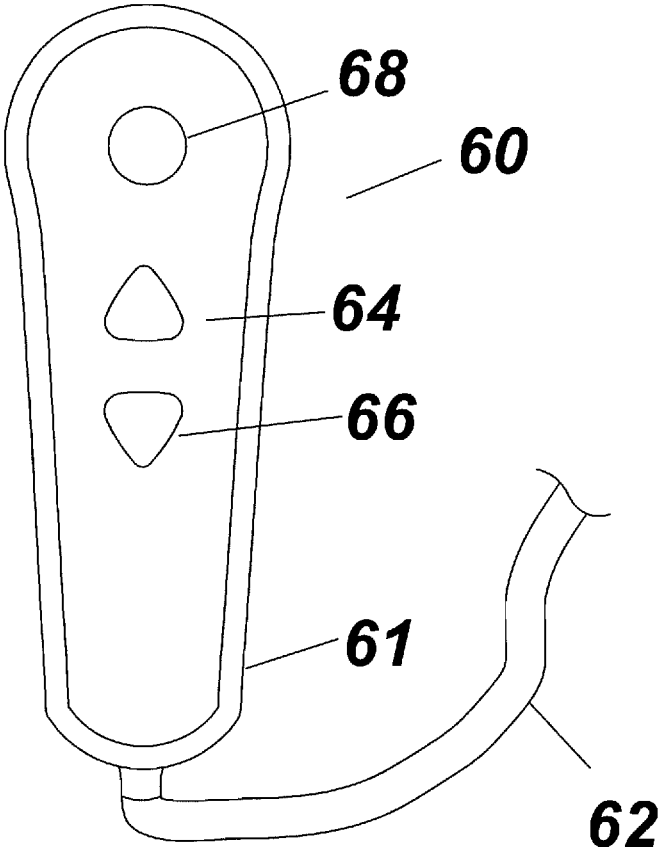
FIG. 8 is a front view of the controller for the linear actuator.

FIG. 8 illustrates the controller 60 which contains rechargeable batteries 61. During recharge, the handset controller is removed from the bath lift and the cord set 62 connected to an AC battery charger, not shown. The controller 60 includes raise 64 and lower 66 buttons and a selector switch 68 to select between operating the backrest 44 or seat scissor assembly 38. Intelligent logic placed in the controller 60 prevents lowering of the seat assembly if there is not enough power to again raise the seat assembly. The controller further includes intelligent logic to prevent tilting the backrest if there is not enough power to return the backrest to an upright position.

All components of the present invention are contemplated to be comprised of rigid, rust resilient materials. For ease of use, in one embodiment, the present invention is constructed of sturdy lightweight recyclable plastic.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A rotating bath lift comprising:

a base defined by a bottom surface and a top surface;

a scissor rod assembly having a proximal end secured to said top surface of said base and a distal end movable from a stowage position to a deployed position;

a seat assembly secured to the distal end of said scissor rod assembly, said seat assembly having a recessed cavity for receipt of a rotatable pad;

a backrest hingedly attached to said seat assembly;

a linear actuator powered by direct current (DC) attached to said scissor rod assembly and said backrest, said linear actuator constructed and arranged for raising and lowering said seat assembly, said linear actuator attached to said backrest and constructed and arranged for tilting said backrest between an upright and reclined position; and a controller releasably coupled to said linear actuator, said controller having rechargeable batteries sized to operate said linear actuator.

2. The bath lift according to claim 1 wherein said pad is medical-grade, closed cell, molded polyurethane.

3. The bath lift according to claim 1 wherein a plurality of suction cups are fixedly attached to said bottom of the base for frictionally engaging a bathtub surface.

4. The bath lift according to claim 1 wherein said seat assembly includes a plurality of apertures placed in said recessed cavity for water drainage.

5. The bath lift according to claim 1 wherein said controller includes intelligent logic to prevent lowering the seat assembly if there is not enough power to raise the seat assembly.

6. The bath lift according to claim 1 wherein said controller includes intelligent logic to prevent tilting the backrest if there is not enough power to return the backrest to an upright position.

7. A rotating bath lift comprising:

a base defined by a bottom surface and a top surface, said bottom surface including a plurality of suction cups fixedly attached for frictionally engaging a bathtub surface;

a scissor rod assembly having a proximal end secured to said top surface of said base and a distal end movable from a stowage position to a deployed position;

a seat assembly secured to the distal end of said scissor rod assembly, said seat assembly having a recessed cavity for receipt of a rotatable pad;

a backrest hingedly attached to said seat assembly;

a DC linear actuator attached to said scissor rod assembly and said backrest, said linear actuator constructed and arranged for raising and lowering said seat assembly, said linear actuator attached to said backrest and constructed and arranged for tilting said backrest between an upright and reclined position; and a controller releasably coupled to said linear actuator, said controller having rechargeable batteries sized to operate said linear actuator; said controller including intelligent logic to prevent lowering the seat assembly if there is not enough power to raise the seat assembly.

8. The bath lift according to claim 7 wherein said top surface includes two parallel channels to cooperate with said scissor rod assembly.

9. The bath lift according to claim 7 wherein said rotatable pad is comprised of medical-grade, closed cell, molded polyurethane padding.

10. The bath lift according to claim 7 wherein said seat assembly includes a plurality of apertures placed in said recessed cavity for water drainage.

11. The bath lift according to claim 7 wherein said controller includes intelligent logic to prevent tilting the backrest if there is not enough power to return the backrest to an upright position.

12. The bath lift according to claim 7 including at least one flap attached to said seat assembly by a living hinge.

* * * * *